US005398872A

United States Patent [19]

Joubran

[11] Patent Number: 5,398,872

[45] Date of Patent: Mar. 21, 1995

[54] MULTIFUNCTION SHOWERHEAD ASSEMBLY

[75] Inventor: Raymond Joubran, Alhambra, Calif.

[73] Assignee: Interbath, Inc., Industry, Calif.

[21] Appl. No.: 101,195

[22] Filed: Aug. 3, 1993

[51] Int. Cl.[6] ..... B05B 3/14

[52] U.S. Cl. ..... 239/99; 239/446

[58] Field of Search ..... 239/443, 446–448, 239/380, 99

[56] References Cited

U.S. PATENT DOCUMENTS

| | | | |
|---|---|---|---|
| 3,762,648 | 10/1973 | Deines et al. . | |
| 3,801,019 | 4/1974 | Trenary . | |
| 4,190,207 | 2/1980 | Fienhold et al. . | |
| 4,203,550 | 5/1980 | On | 239/449 X |
| 4,303,201 | 12/1981 | Elkins et al. . | |
| 4,398,669 | 8/1983 | Fienhold et al. . | |
| 4,754,928 | 7/1988 | Rogers et al. | 239/449 X |
| 5,201,468 | 4/1993 | Freier et al. | 239/440 |

FOREIGN PATENT DOCUMENTS

| | | | |
|---|---|---|---|
| 3706320 | 3/1988 | Germany | 239/447 |

*Primary Examiner*—Gregory L. Huson
*Assistant Examiner*—Kevin Weldon
*Attorney, Agent, or Firm*—Graham & James

[57] ABSTRACT

A multifunction showerhead or hand held showerhead assembly, capable of providing a series of water spray effects. The primary components of the showerhead assembly are a fluid directing valve assembly which includes a pair of generally cup shaped members co-axially mounted with opposing end faces proximate to one another. One of the generally cup shaped members has a bottom surface defining a plurality of fluid flow passageways. When the second member is rotated in opposing relationship to the base of the first member, the fluid flow passageways direct the fluid flow from an orifice in the first member to a pair of outlet passages, or alternatively to a sealed chamber.

13 Claims, 7 Drawing Sheets

MULTIFUNCTION SHOWERHEAD ASSEMBLY

FILED OF THE INVENTION

The present invention relates to the field of showerhead assemblies and more particularly to a multifunction showerhead having a hydraulic valve design enhancing the ease of use of the multiple functions.

BACKGROUND OF THE INVENTION

Multifunction showerheads have gained widespread popularity by allowing the user to select from a variety of water spray effects, such as a continuous spray, a pulsating jet or massage spray, an aerated spray, and the like. However, current designs for multifunction showerheads are complex in terms of the number of mechanisms used to select the spray effect. The current showerhead assemblies require a number of moveable parts and multiple O-rings assembled in a manner that allows the user to adjust between the various types of sprays. The multiple elements in the showerhead assemblies require complex machining and fabrication techniques and may be difficult to assemble. Moreover, while current designs may operate satisfactorily while new, after a period of use they are subject to deposits of calcium which build up and clog the fluid flow passages as well as hamper the cooperative engagement of the moveable pieces. Thus, with increasing use, the mechanism allowing adjustability between the various spray functions of current multifunction showerhead assemblies become encumbered and difficult to use.

Accordingly, a design for a multifunction showerhead capable of providing a variety of spray effects, which reduces the complexity of the assembled components, minimizes the fabrication and assembly costs, and resists build-up of deposits, yet maintains or reduces the force required for the user to adjust between the functions of the showerhead assembly would be desirable.

SUMMARY OF THE INVENTION

The present invention is directed to a multifunction showerhead or hand held showerhead assembly, capable of providing a series of water spray effects. The primary components of the showerhead assembly are a fluid directing valve assembly which includes a pair of generally cup shaped members co-axially mounted with opposing end faces proximate to one another.

One of the cup shaped members receives the water from a supply source in the open cavity of the cup, and includes an elongated slot in the bottom of the cup through which the water flow is directed. The bottom face of the cup also includes a projecting pin or cam which interengages a semicircular elongated slot in the opposing generally cup shaped member.

The second or opposing generally cup shaped member has a bottom surface defining a plurality of fluid flow passageways. When the second member is rotated in opposing relationship with the elongated slot in the base of the first cup shaped member, the fluid flow passageways direct the fluid flow to a pair of outlet passages, or alternatively to a sealed chamber. The bottom face of the second member also includes a plurality of grooves to define seats for O-rings, which contact and seal against the opposing surface of the first cup shaped member, to seal the respective passageways.

By the configuration of the two opposing surfaces of the generally cup shaped members, in combination with the effect of the O-rings, the ability of the user to rotate an adjustor ring to control the fluid flow requires minimal amount of force, yet once positioned, the selected fluid flow effect or combination of effects will be maintained. The multifunction shower assembly may also include a rotating flow control element to provide a pulsing shower effect, and provides interlocking mechanisms to prevent inadvertent disassembly of the multifunction showerhead assembly during use.

DETAILED DESCRIPTION OF THE PREFERRED EMBODIMENTS

Figure 1:
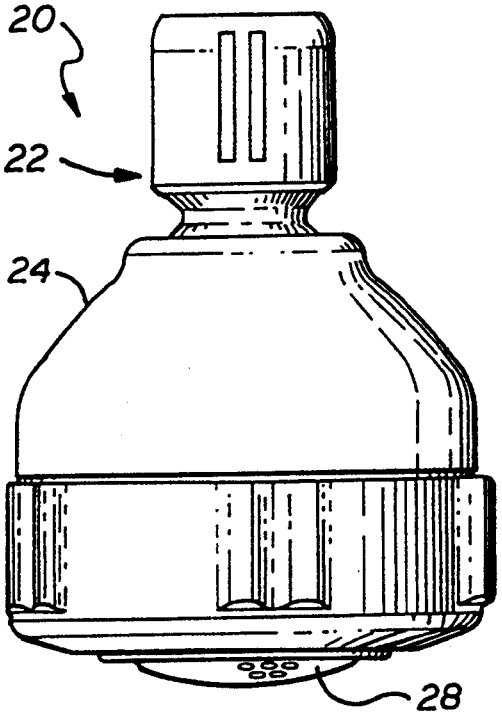
FIG. 1 is a side view of a multifunction showerhead of the present invention.
Figure 2:
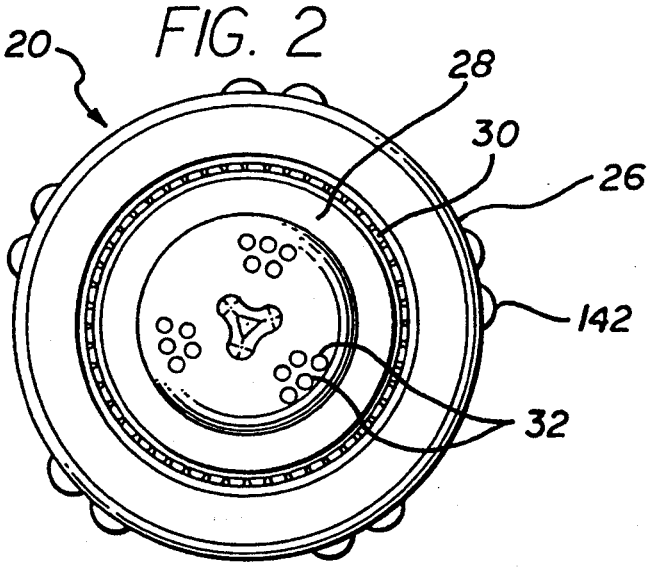
FIG. 2 is a face view of the multifunction showerhead of FIG. 1.

FIGS. 1–4 depict a side view, a face view, an axial cross-sectional view, and an exploded view, respectively, of the multifunction showerhead 20 of the present invention. The multifunction showerhead 20 includes a ball joint assembly 22, a housing 24, a rotating ring assembly 26, and a face plate 28. The multifunction showerhead according to FIGS. 1–4 is capable of providing a needle spray pattern from the outer spray ring 30 as well as a pulsating spray or massage spray from the pulsating spray ports 32. In addition, the multifunction showerhead 20 can be adjusted to limit or shut off the water from the showerhead.

The ball joint assembly 22 includes a cylindrical, internally threaded section 40 adapted for mating with a water pipe projecting from the wall of the shower (not shown), as well as a partially spherical ball element 42 which allows the housing 24 to be mounted in a manner such that it can be rotated into a preferred angle of orientation for the user. Those skilled in the art will appreciate that the ball joint assembly 22 may include a flow controller, retainer, O-ring, screen, and rubber washer (not shown) constructed of standard components known in the industry. For the sake of clarity of the drawings, these components have been omitted in the cross-sectional view of FIG. 3. The ball element 42 includes an outlet nozzle 44 axially disposed so as to direct the water flow to the housing 24 of the showerhead 20.

The housing 24 includes a flaring outer shell 50 and a stepped axial section 52. The stepped axial section 52 includes an internal step 54 into which a split ring retainer 56 fits. The split ring retainer 56 secures the housing 24 about the ball element 42. The split ring retainer 56 is a cylindrical element having an axially aligned cut allowing the split ring retainer 56 to be expanded for placement about the spherical ball element 42. The split ring retainer 56 includes a semi-spherical inner surface closely matching the exterior spherical surface of the ball element 42, and a stepped cylindrical outer surface which fits snugly within the step 54 of the stepped axial section 52 of the housing 24. The split ring retainer 56 is sealed by the use of an O-ring 58. The stepped axial section 52 also includes an internal thread 60, and terminates at an end face 62 having a plurality of ratchet steps 64.

Figure 3:
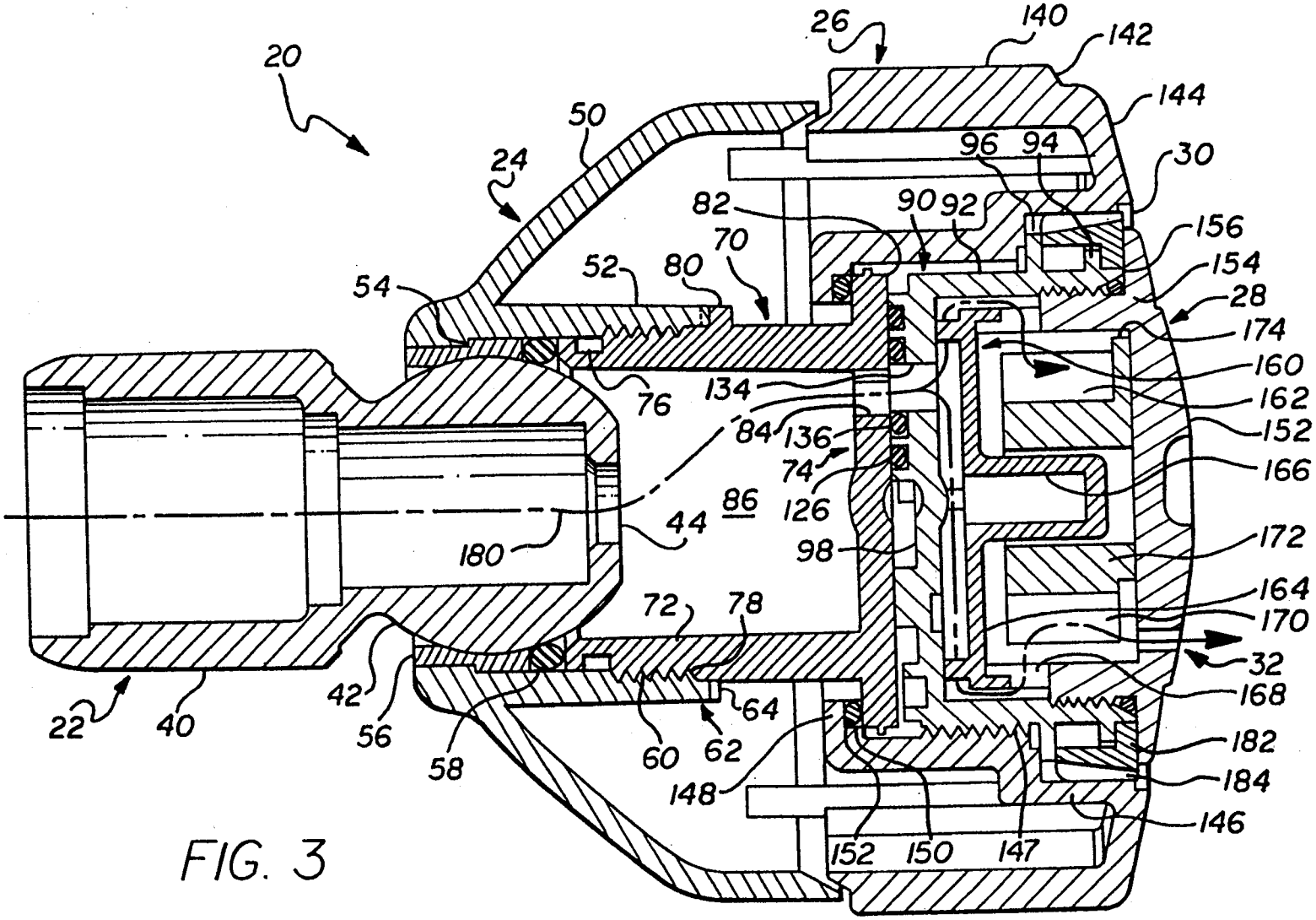
FIG. 3 is a cross-sectional view of the multifunction showerhead of FIGS. 1 and 2.
Figure 4:
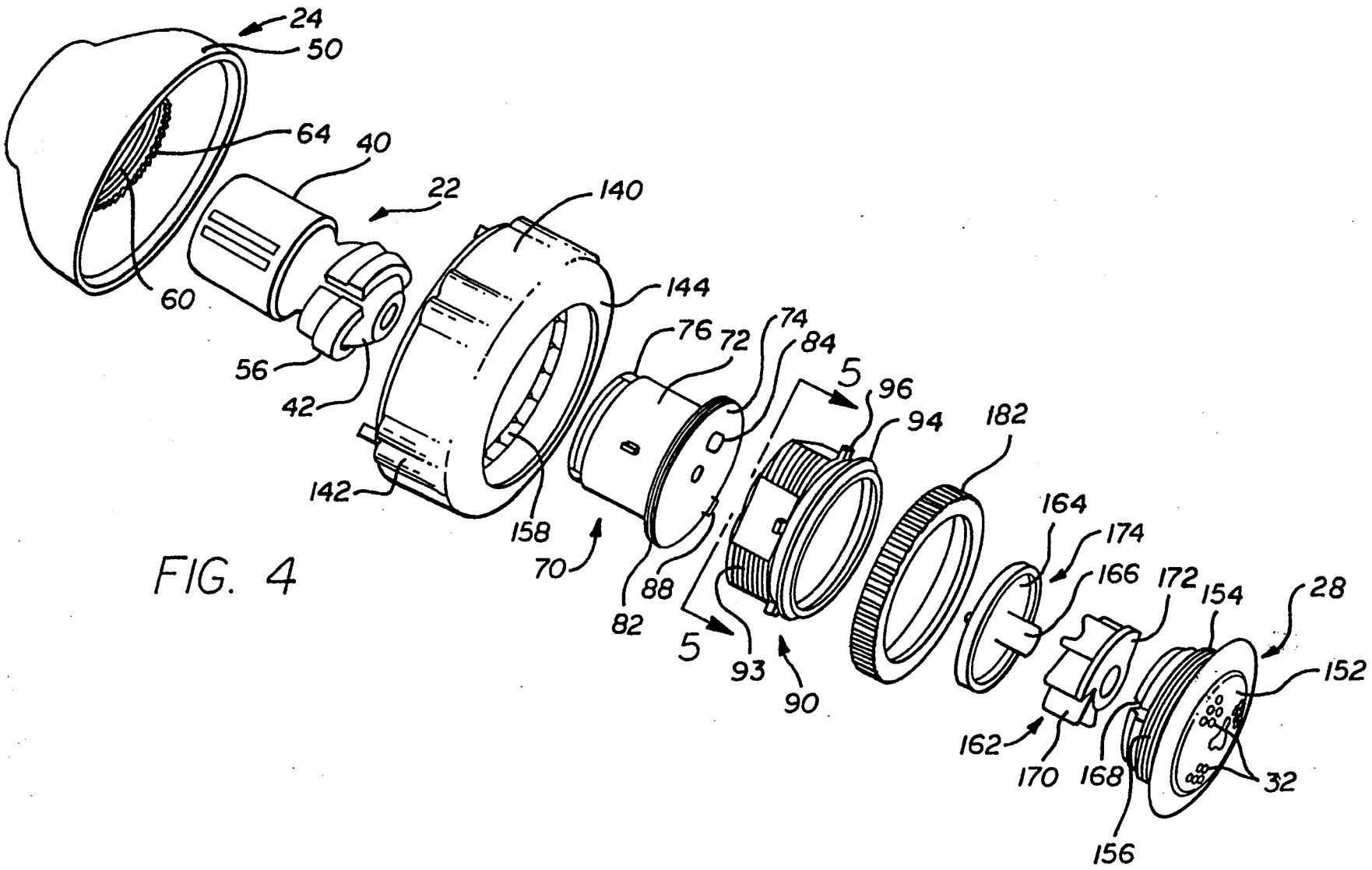
FIG. 4 is an exploded isometric view of the multifunction showerhead of FIGS. 1–3.
Figure 5:
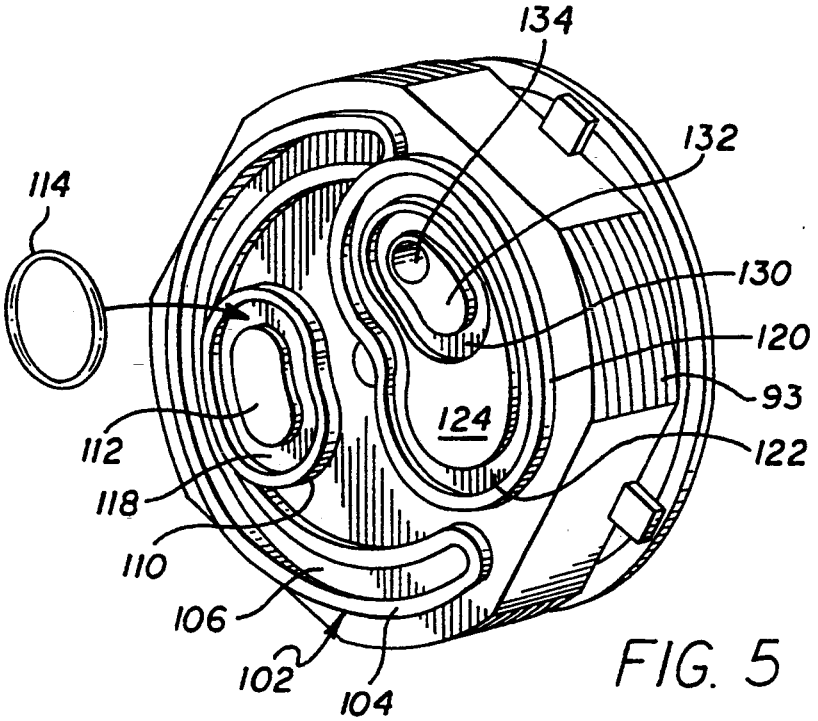
FIG. 5 is an isometric view of the selector disk taken along line 5—5 of FIG. 4.

The components primarily responsible for directing the flow of water through the multifunction showerhead 20 include a valve body 70 and a selector disk 90 depicted in the cross-sectional view of FIG. 3, and in the detailed isometric views of FIGS. 4 and 5, respectively. The following discussion of the valve body 70 is directed to the views in FIGS. 3 and 4, while the discussion of the selector disk 90 is directed to FIGS. 3–5.

The valve body 70 includes a cylindrical portion 72 and a base 74. The cylindrical portion 72 may include a groove 76 for receiving an O-rings proximate the end located furthest from the base 74. The cylindrical portion 72 may also include an externally threaded portion 78 for engaging the internal thread 60 of the stepped axial section 52 of housing 24. The cylindrical portion 72 of the valve body 70 may also include a pair projecting tabs 80, operative to lock the valve body 70 in a fixed location with respect to the housing 24, by engaging the ratchet steps 64 at the end of the stepped axial section 52 of housing 24. Following assembly, the combination of the tabs 80 and the ratchet steps 64 lock the valve body 70 to the housing 24, precluding disassembly of the ball joint assembly 22 from the housing 24 and valve body 70.

The base 74 of the valve body 70 includes a flange or rim 82 which extends radially outwardly from the cylindrical portion 72. The base 74 also includes an elongated slot 84 which extends through to an internal chamber 86 defined by the cylindrical portion 72 of the valve body 70. The elongated slot 84 allows water to flow from the internal chamber 86 of the cylindrical portion 72 through the elongated slot 84. The base 74 also preferably includes a projecting guide element 88, the function of which will be detailed below.

The selector disk 90 of FIGS. 3–5 is designed to be placed closely abutting the end face of the base 74 of the valve body 70, as depicted in the cross-sectional view of FIG. 3. FIG. 5 depicts the details of the surface of the selector disk 90 located adjacent the end face of base 74. The selector disk 90 includes a generally octagonal wall section 92, at least two of the octagonal walls are arcuate and include an external thread 93. The selector disk 90 includes a rim 94 affixed to one end of the generally octagonal wall section 92, spaced behind the rim 94 is a plurality of tabs 96. The rim 94 is located at the opposite end of the octagonal wall 92 from a selector plate 98 of the selector disk 90.

Means for controlling and directing the flow of water from the elongated slot 74 of the valve body 70 are affixed to the selector plate 98. In addition, a slot guide means 102 is affixed to the base of the selector plate 98. The slot guide means 102 includes a raised rib 104 which includes a pair of walls generally defining the outer and inner surfaces of a C-shaped channel 106, whereby the guide element 88 projecting from the base 74 of the valve body 70 is configured to be placed between and constrained by the inner and outer portions of the rib 104, to control and guide the cooperative rotation of the selector disk 90 with respect to the valve body 70 between the respective ends or stops at the edge of the C-shaped channel 106.

The means for controlling and directing water flow includes a first generally oval shaped rib 110 surrounding an elevated land 112, the shape of which is generally equivalent to the shape of the elongated slot 84 of the valve body 70. The rib 110 and land 112 are configured to allow an O-rings 114 to be placed in a channel 118 therebetween. The O-rings 114 is selected and sized to project slightly above the rib 110 and land 112, such that the O-rings 114 will contact the base 74 of the valve body 70. When the two elements are cooperatively assembled. The shape and position of the land 112 is configured such that when the land 112 is rotated to be positioned facingly across from the elongated slot 84, the water flow from the elongated slot 84 is blocked by the land 112 and sealed by the O-rings 114. This design allows the user to shut off the water flow simply by turning the rotating ring 26 of FIG. 1 to a particular angular location.

The means for controlling and directing water flow further comprises a generally peanut shaped rib 120 surrounding smaller, a generally peanut shaped land 124, separated by a channel 122 into which an O-rings 126 may be placed. The peanut shaped land 124 further defines a channel 130 surrounding a part-oval land 132. The part-oval land 132 is bisected by a bore forming an outlet port 134 which allows the water projecting from the elongated slot 84 of the valve body 70 to traverse axially through the outlet port 134 of the selector plate 98, when the elongated slot 84 is aligned with the outlet port 134. An O-rings 136 placed within the channel 130, as well as O-rings 126 within channel 122 are designed to project slightly from the respective channels to seal against the opposing base 74 of the valve body 70.

The means for controlling and directing water flow of the selector plate 98 allows for a plurality of alternative fluid flow paths upon rotation of the selector plate 98 with respect to the valve body 70, and more particularly with respect to the elongated slot 84 from which the water flow projects. Thus, the respective lands may block the flow of water from the elongated slot 84, while the outlet port 134 allows the water to proceed generally axially through the selector plate 98. If the elongated slot 84 is not blocked by one of the respective lands 112, 124, 132 or is not aligned with the outlet port 134, then the water from elongated slot 84 will be directed against the surface of the selector plate 98, flowing radially outward and then cascading around the generally octagonal walls 92 before being directed to the outer spray ring 30.

Due to the shape of the elongated slot 84, in cooperation with the shapes of the lands and channels of the selector plate 98, the water flow may be either totally blocked, partially blocked with a portion proceeding to the outer spray ring 30, all of the flow proceeding to the outer spray ring 30, a portion of the flow being directed to the outer spray ring 30 and a portion being directed to the pulsating spray ports 32, or all of the water may be directed to the pulsating spray ports 32. Further, the proportion of flow between any of the respective foregoing modes is continuously adjustable by rotation of the rotating ring 26 by the user, to select the desired combination or quality of the resulting fluid flow. As may be appreciated, if a portion of the elongated slot 98 is blocked by a land on the selector plate 98, the flow velocity and pressure through the unblocked portion, and thus ultimately through the spray ports 32 or spray ring 30 will increase proportionally.

The rotating ring 26 is generally a part-toroid shaped element having an outer wall 140 with plurality of raised bumps 142 which allow the user to more readily grip the rotating ring 26. At a forward face 144 of the rotating ring 26, an angled face element projects radially inward and terminates at a cylindrical inner wall 146 which proceeds in a stepped fashion axially backward from the forward face 144. An inner surface of this inner wall 146 may be internally threaded 147 so as to threadably engage the selector disk 90, as will be discussed in greater detail below.

The inner wall 146 proceeds to an axially inward end were it terminates at a radially inwardly projecting flange 148. The flange 148 defines a channel 150 into which an O-rings 152 may be placed. The flange 148 is design to abut against the rim 82 of the valve body 70, which is designed to be inserted axially through the rotating ring 26. The flange 148 also preferably includes a pair of slots which allow passage of the tabs 80 on the valve body 70.

The tabs 96 on the selector disk 90 serve as stops to limit the axial engagement of the selector disk 90 with the rotating ring 26. The inner wall 146 of the rotating ring 26 may further include a step having plurality of ratchet steps 158, which may cooperate with tabs 96 of the selector disk 90 to lock the selector disk 90 to the rotating ring 26 upon assembly.

The primary components of the multifunction showerhead 20 are assembled as shown in the exploded view of FIG. 4, by inserting the cylindrical portion of the valve body 70 axially through the rotating ring 26, such that the rim 82 of valve body 70 abuts against the radially inwardly extending flange 148 of the rotating ring 26. Thereafter, the selector disk 90 is inserted axially into the rotating ring 26 and threadably engaged therewith to securely place the base 74 of the valve body 70 and the selector plate 98 of the selector disk 90 in opposing facing relationship. The assembly is then inserted into the housing 24 and the threads on the axially proximal end of the cylindrical portion of the valve body 70 threadably engage the internal threads of the cylindrical portion of the housing 24.

The face plate 28 depicted in the cross section of FIG. 3 includes a front disk 152, which includes the plurality of ports 32. An outer rim on the face plate 28 retains an outer spray ring 182 in place. The face plate 28 also includes a cylindrical portion 154 projecting back from the backside of the front disk 152, which includes an external thread 156 to engage an internal thread of the selector disk 90.

For the multifunction showerhead 20 which is capable of a pulsating massage or interrupted fluid flow through the pulsating spray ports 32, a flow diverter element 160 and a rotor 162 are mounted between the face plate 28 and the inner portion of the selector disk 90. The flow diverter element 160 includes a disk shaped portion 164 and an axial cylindrical portion 166, about which the rotor 162 is mounted. The disk portion 164 acts as a flow diverter to direct the water flow radially outward along the outer surface of the disk 164 and around the edge thereof, through ports 168 in the cylindrical portion 154 of the face plate 28, in a manner such that the water is directed radially inward against the rotor 162, and more particularly the blades 170 thereof.

The rotor 162, shown in the exploded isometric view of FIG. 4, includes a cylindrical portion 172 onto which the blades 170 are mounted and extend radially outward, and also includes a partial disk portion 174 which, upon rotation of the rotor 162 successively blocks various of the pulsating spray ports 32, to thereby provide a pulsating effect.

The arrows 180 in FIG. 3 show the fluid flow proceeding from the nozzle 44 of the ball joint 42 into the internal chamber 86 of the valve body 70 then through the elongated slot 84 and through the outlet port 134 of the selector disk 90, then radially outward along the face of the flow diverter element 160 to the edge thereof, turning and proceeding radially inward through ports 168 to the blades 170 of rotor 162 and thereafter proceeding outward through the pulsating spray ports 32.

As may be appreciated, upon rotation of the rotating ring 26 and the selector disk 90 which is mounted thereto, the outlet port 134 of selector disk 90 will be moved out of alignment with the elongated slot 84 of valve body 70, thereby shutting off the fluid flow through the outlet port 134 of the selector disk 90 and terminating the water flow through the pulsating spray ports 32.

Figure 6:
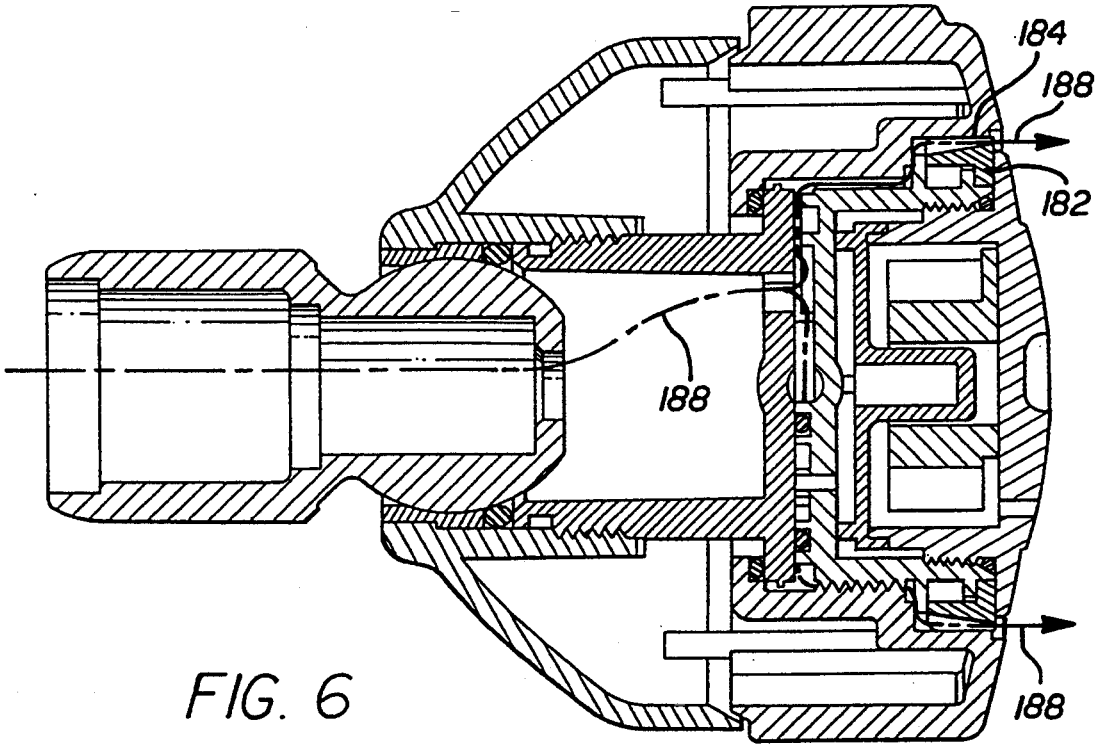
FIG. 6 is a cross-sectional view of the multifunction showerhead similar to FIG. 3, showing the water flow path to the outer spray ring.
Figure 8:
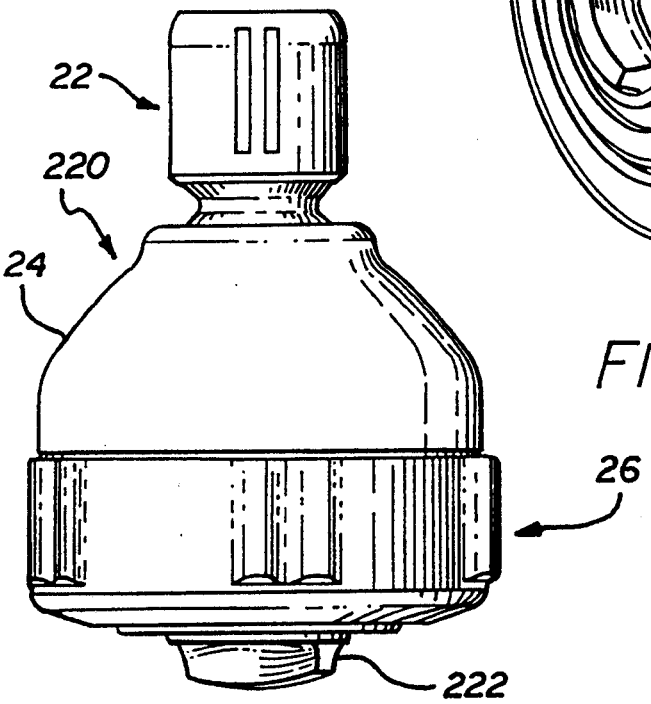
FIG. 8 is a side view of an alternative version of the multifunction showerhead.
Figure 9:
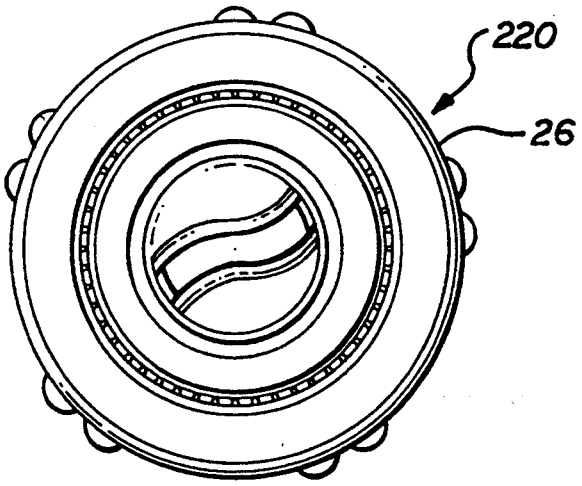
FIG. 9 is a face view of the alternative version of the multifunction showerhead of FIG. 8.

When the rotating ring 26 is rotated to a point wherein the elongated slot 84 is aligned with a portion of the selector plate 98 which is not bounded by one of the elements 110 or 120 as depicted in FIG. 6, the water flowing from the elongated slot 84 is directed against the surface of the selector plate 98 and proceeds radially outward thereabout, to the edge of one of the octagonal sides then cascades down the octagonal sides of the selector disk 90. The water approaches a cavity 180 between the outer surface of the selector disk 90 and the inner surface of the rotating ring 26 which includes an outer spray ring 182 having a plurality of ports 184. The water proceeds through the plurality of ports 184 and out through the front of the multifunction showerhead 20 at spray ring 30. The resulting flow is a fine spray or needle spray emitted from a generally circular array of ports 184. This water flow is depicted in the view of FIG. 6 by the arrows 188.

Again, as may be appreciated, if the rotating ring 26 is rotated such that the elongated slot 84 of the valve body 70 is partially aligned within one of the rib elements 110 or 120 and partially outside of the respective elements 110 or 120, then a portion of the fluid flow will be directed to the outer ring and another portion will either be blocked or will proceed to the outlet port 134 within the selector disk 90 and thereafter through the pulsating spray ports 32.

Figure 7:
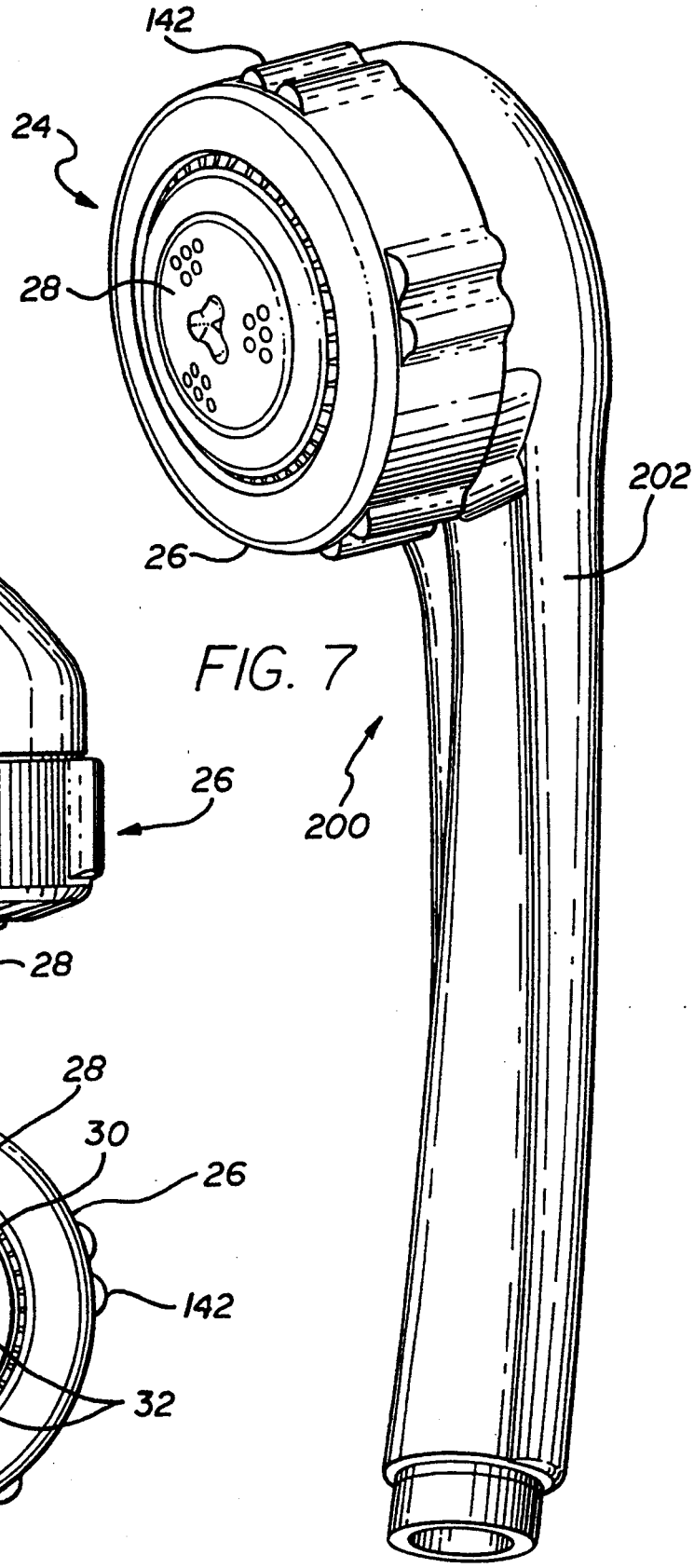
FIG. 7 is an isometric view of the handheld version of the multifunction showerhead of FIGS. 1–6.

In the handheld option for a showerhead 200 shown in FIG. 7, the housing 24, ball joint assembly 24, and split ring 26 of FIGS. 1–6 are replaced by a handle-shell 202 using the same valve body components of FIGS. 1–6, by adding an O-rings (not shown) to the neck of the valve body.

FIGS. 8–11 depict an alternative embodiment of a multifunction showerhead 220. The showerhead 220 has a number of components similar to the components of the showerhead 20 of FIGS. 1 through 6. For clarity in FIG. 10, the elements which are identical to the elements in the multifunction showerhead 20 discussed above will not be labeled and discussed herein with respect to the multifunction showerhead 220, unless required. Instead, it may be appreciated that the face plate 28, flow diverter element 160 and rotor 170 shown in FIGS. 3 and 4 for the multifunction showerhead 20, have been replaced in the embodiment shown in FIGS. 8–11 for the multifunction showerhead 220, as discussed below.

Figure 10:
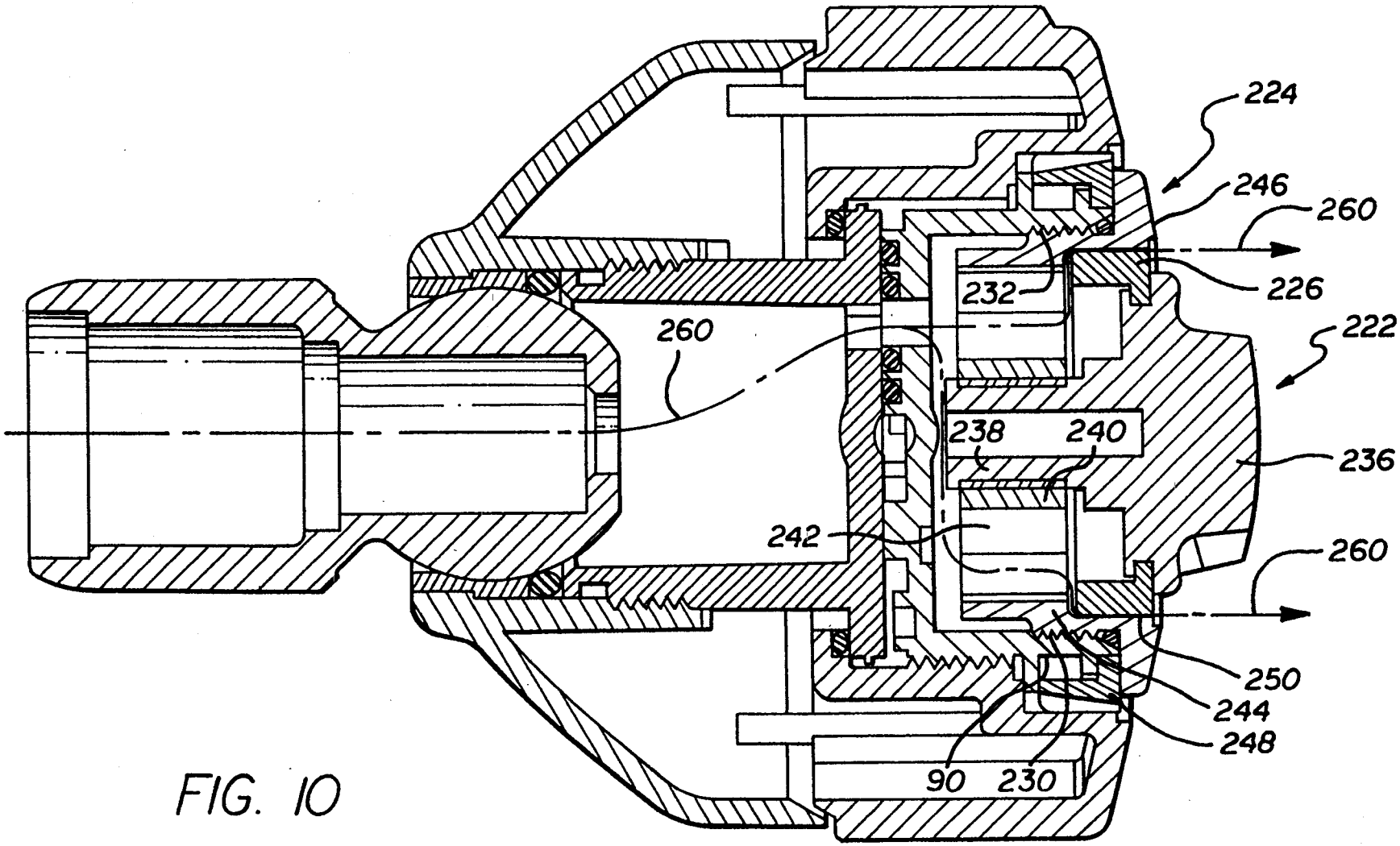
FIG. 10 is a cross-sectional view of the alternative multifunction showerhead of FIGS. 8 and 9 according to the present invention.

The multifunction showerhead 220 as shown in the cross sectional view of FIG. 10, includes a dial element 222, a locking sleeve 224, and an inner spray ring 226. These elements are assembled together and then a thread 230 on the outer surface of locking sleeve 224 is threadably engaged with an internal thread 232 of the internal surface of selector disk 90. The dial element 222 includes a central portion having a graspable projection 236 and an externally threaded cylinder 238 projecting therefrom.

The locking sleeve 224 includes a cylindrical central portion 240 having an internal thread which receives the threaded cylinder 238 of dial element 222. The locking sleeve 224 also includes a plurality of arms 242 extending radially outward from the central cylindrical portion 240 and terminating at a cylindrical ring 244. The cylindrical ring 244 includes the external threads 230 and a flange portion 246 at the forward face which acts to retain the outer spray ring 248 in place.

By rotating the dial element 222 with respect to the locking sleeve 224, the inner spray ring 226 is squeezed to thereby cause the water flow through a plurality of ports 250 within the spray ring 226 to be restricted, changing or adjusting the resulting spray between a needle type spray and a fine spray.

It should be noted that, within the multifunction showerhead 220, the inner spray ring 226 as well as the outer spray ring 248 may be cleaned by unscrewing the locking sleeve 224 from the selector disk 90 and thereafter the dial element 222 from the locking sleeve 224 to allow access to the respective spray rings 226, 248. The inner spray ring 226 as well as the outer spray rings 182 (FIG. 3) and 248, are made out of flexible resilient material that resist calcium deposits which can be cleaned by removing the ring and flexing it under hot water or by brushing the spray forming grooves to dislodge any calcium buildup, and then simply reassembled into the multifunction showerhead 220.

Each spray ring 182, 226, 248 preferably consists of a series of at least 3 angled bores having different pitch widths at the end distal from the outer face, that produce a constant full spray without any voids. The inner spray ring 226 makes a smaller diameter full spray than the outer spray ring 248. When both the inner spray ring 226 and the outer spray ring 248 are being used simultaneously, the sprayed area is full with at least 6 different spray circles.

Figure 11:
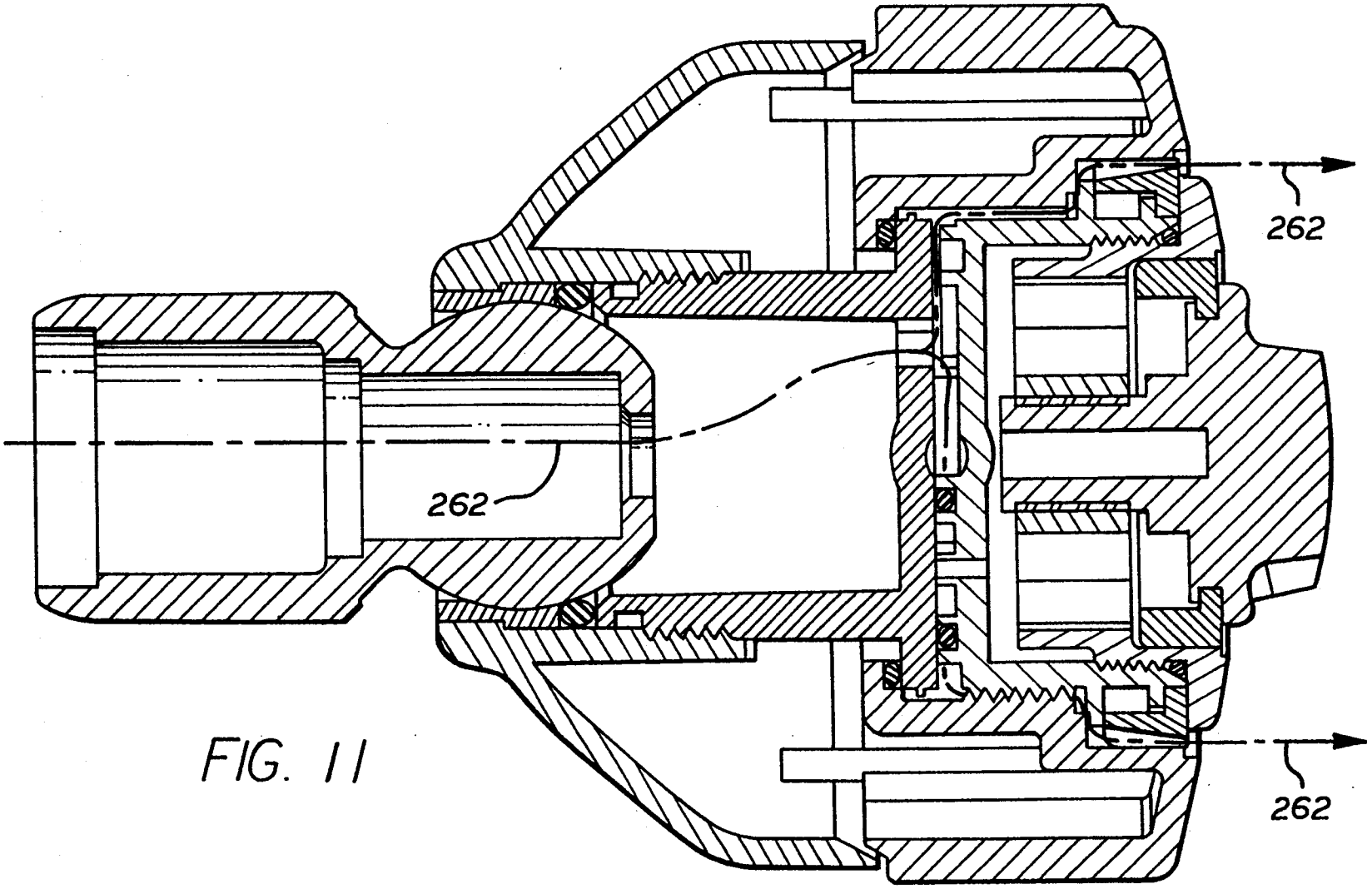
FIG. 11 is a cross-sectional view similar to FIG. 10 depicting the flow through the showerhead to the outer spray ring.

As in the embodiment of FIGS. 1 through 7, the multifunction showerhead 220 includes the selector disk 90, the orientation of which is controlled by rotation of the rotating ring 26 such that the fluid flow is directed either through the outlook port 134 or around the selector disk 90 to cascade down the octagonal walls and outward through the outer spray ring 248, as depicted by the arrows 260 and 262 in FIGS. 10 and 11, respectively.

Figure 12:
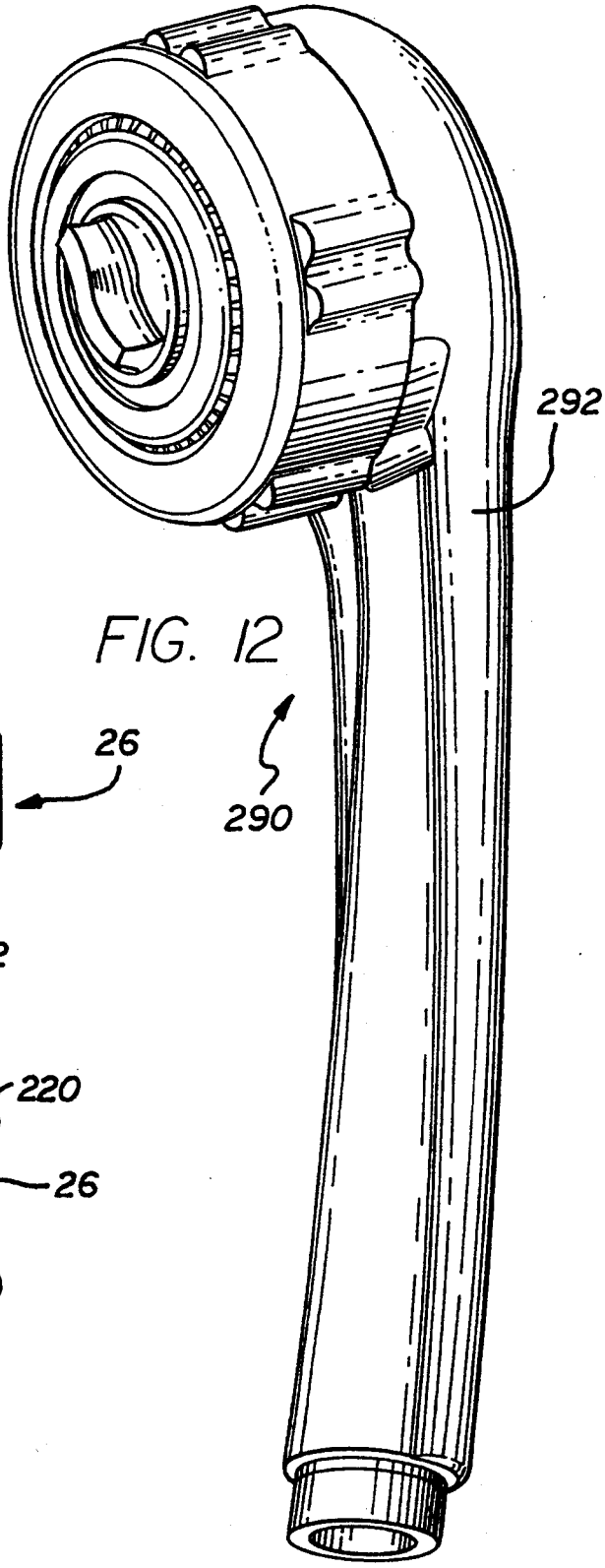
FIG. 12 is an isometric view of the handheld version of the multifunction showerhead of FIGS. 8–11.

In the handheld option for a showerhead 290 shown in FIG. 12, the housing 24, ball joint assembly 24, and split ring 26 are replaced by a handle-shell 292 using the same valve body components of FIG. 10, by adding an O-rings (not shown) to the neck of the valve body.

As can be seen, the present invention presents a much simpler valve mechanism that requires few parts and yet which can be made to perform all the necessary functions for providing various spray effects and a hold position. It also requires much fewer parts to orient the user's force in the manner necessary for proper operation.

In the foregoing description of the present invention, a preferred embodiment of the invention has been disclosed. It is understood that other mechanical and design variation are within the scope of the present invention. Furthermore, additional O-rings or series of O-rings can be used on the selector plate or valve body to provide a series of additional spray effects. Accordingly, the present invention is to be limited only by the proper literal and equivalent scope of the appended claims.

What is claimed is:

1. A showerhead providing a plurality of spray effects, comprising:

inlet port means for establishing fluid communication with a source of water;

first outlet port means for directing a spray of water with a first spray effect;

second outlet port means for directing a spray of water with a second spray effect;

means for variably restricting the flow of water through the showerhead;

a selector plate means internally contained in said showerhead between said inlet port means and said first and second outlet ports means and oriented generally perpendicular to the flow of water from said inlet port means, for selectively directing water flow to said first and second outlet port means to establish fluid communication with said inlet port means, said selector plate including surface features and a shape which permits water to flow in at least one of three paths of through, around and both through and around the selector plate; and control ring means manually controlled for positioning said selector plate means to selectively open said first and second outlet port means, whereby any combination of different spray effects can be continuously selected.

2. The showerhead of claim 1, wherein said inlet port means comprises:

a surface defining a fluid chamber, said fluid chamber having an upstream opening for receiving water from said source and also having a downstream opening; and passageway means, defined by said surface features in said selector plate, for providing fluid communication between said downstream opening and said different outlet port means under the control of said control ring means.

3. The showerhead of claim 2, wherein each of said first and second outlet port means comprises:

a series of outlet passages in fluid communication with said passageway means controllably directing water from said downstream opening in said inlet port means through said passageway means, to none, one or more of said outlet passages; and a pair of spray means for generating said plurality of spray effects, each of said spray means being in fluid communication with one of said outlet passages.

4. The showerhead of claim 2, wherein said selector plate comprises:

valve sealing means, selectively movable to block said downstream opening portions of said passageway means and to allow communication between said downstream opening of said outlet port means.

5. The showerhead of claim 3 wherein said plurality of spray means comprises:

first spray means for providing a continuous spray; and second spray means for providing a pulsating spray or continuous spray from said showerhead.

6. The showerhead of claim 5 wherein said continuous spray means comprises:

a face plate in fluid communication with one of said outlet passages, said face plate including a spray ring defining a series of angled bores in constant fluid communication with said one of said outlet passages.

7. The showerhead of claim 5 wherein said pulsating effect means comprises:

a face plate defining a series of discharge passages;

rotor means positioned for rotation adjacent said discharge passages, for interrupting the flow of water through each of said passages; and channel means, in fluid communication with said discharge passages and one of said outlet passages, for providing a tangential stream of water to said rotor means to impart rotation to said rotor means and to supply water to said discharge passages.

8. A showerhead comprising:

inlet means for establishing fluid communication with a source of water;

first means for directing a spray of water with a first spray effect;

second means for directing a spray of water with a second spray effect;

flow selection means for selectively directing water flow to said first and second means, wherein said flow selection means includes a selector plate internally contained in said showerhead between said inlet means and said first and second means, said selector plate oriented generally perpendicular to the flow of water from said inlet means, said selector plate including an end face having surface features defining at least two alternative fluid flow paths, said surface features including:

first means for defining a first channel having fixed width and depth dimensions;

an O-rings placed in said first channel defined by said first means, said O-rings having a diameter greater than the depth of said first channel;

means for diverting a flow of water constrained within said O-rings to said first means for directing a spray of water;

means for directing a flow of water constrained outside of said O-rings to said second means for directing a spray of water;

second means for defining a second channel having fixed width and depth dimensions, said second means for defining a second channel being disposed about said first means for defining a first channel;

a second O-rings placed in said second channel defined by said second means, said second O-ring having a diameter greater than the depth of said second channel; and an elevated land disposed between said first O-rings and said second O-ring operative to restrict water flow;

means for allowing manual control of said flow selection means, wherein said means for allowing manual control includes a control ring manually controlled for positioning said selector plate to selectively open said first and second means, whereby any combination of different spray effects can be continuously selected; and means for variably restricting the flow of water through the showerhead.

9. The showerhead of claim 8, wherein said inlet means comprises:

a valve body having an end face including an orifice allowing water flow from within said valve body through said orifice, said end face of said valve body positioned facingly opposed to said end face of said selector plate such that said first and second O-rings contact said end face of said valve body.

10. A showerhead comprising:

inlet means for establishing fluid communication with a source of water;

first means for directing a spray of water with a first spray effect;

second means for directing a spray of water with a second spray effect;

flow selection means selectively directing water flow to said first and second means, wherein said flow selection means further includes a selector plate internally contained in said showerhead between said inlet means and said first and second means, said selector plate oriented generally perpendicular to the flow of water from said inlet means, said selector plate includes an end face having surface features defining at least two alternative fluid flow paths;

means for allowing manual control of said flow selection means;

means for interlocking respective components of said showerhead upon assembly to prevent disassembly; and means for variably restricting the flow of water through the showerhead.

11. A showerhead comprising:

inlet means for establishing fluid communication with a source of water;

first means for directing a spray of water with a first spray effect;

second means for directing a spray of water with a second spray effect;

flow selection means for selectively directing water flow to said first and second means;

means for allowing manual control of said flow selection means;

means for interlocking respective components of said showerhead upon assembly to prevent disassembly; and an outer spray ring of resilient material defining a plurality of spray ports disposed within said second means for directing a spray of water with a second spray effect.

12. The showerhead of claim 11, further comprising:

an inner spray ring of resilient flexible material disposed within said first means for directing a spray of water with a first spray effect.

13. The showerhead of claim 11, wherein said first means for directing a spray of water with a first spray effect includes a face plate defining a series of discharge passages, and rotor means positioned for rotation adjacent said discharge passages, for interrupting the flow of water through each of said passages.

* * * * *